US012781734B2

(12) United States Patent
Kammerl et al.

(10) Patent No.: US 12,781,734 B2
(45) Date of Patent: Nov. 3, 2026

(54) GEROTOR PUMP AND MOTOR/PUMP UNIT

(71) Applicant: Thomas GmbH, Herdorf (DE)

(72) Inventors: Louis Kammerl, Herdorf (DE); Etienne Dautry, Daaden (DE); Christian Kretzer, Daaden (DE)

(73) Assignee: Thomas GmbH, Herdorf (DE)

( * ) Notice: Subject to any disclaimer, the term of this patent is extended or adjusted under 35 U.S.C. 154(b) by 203 days.

(21) Appl. No.: 18/805,855

(22) Filed: Aug. 15, 2024

(65) Prior Publication Data

US 2025/0059973 A1 Feb. 20, 2025

(30) Foreign Application Priority Data

Aug. 18, 2023 (DE) ..... 102023122187.6

(51) Int. Cl.
*F04C 2/10* (2006.01)
*F04C 15/00* (2006.01)
*F04C 15/06* (2006.01)

(52) U.S. Cl.
CPC ..... *F04C 2/102* (2013.01); *F04C 15/0026* (2013.01); *F04C 15/0042* (2013.01); *F04C 15/06* (2013.01)

(58) Field of Classification Search
CPC ..... F04C 2/102–104; F04C 14/06; F04C 14/265; F04C 15/0023; F04C 15/0026;
(Continued)

(56) References Cited

U.S. PATENT DOCUMENTS 2,380,783 A * 7/1945 Painter ..... F01C 21/108 418/133
3,104,616 A * 9/1963 Peet ..... F04C 15/0026 418/132
(Continued)

FOREIGN PATENT DOCUMENTS

DE 102011075415 A1 11/2012
DE 102015002352 A1 6/2016
(Continued)

OTHER PUBLICATIONS

DE-112014003790-B4—Traff J—Pump Unit for a Power Take-Off, Power Take-Off for a Take-Off Module, Take off Unit and a Vehicle Including a Power Take-Off—Feb. 7, 2019—the English Machine Translation. (Year: 2019).*
(Continued)

*Primary Examiner* — Nathan C Zollinger
(74) *Attorney, Agent, or Firm* — Harness, Dickey & Pierce, P.L.C.

(57) ABSTRACT

A gerotor pump for conveying a fluid from an inlet pump chamber which is connected to an inlet to an outlet pump chamber, which is connected to an outlet, of the gerotor pump having a rotatable outer rotor; a rotatable inner rotor, which is arranged radially inside the outer rotor; a housing having a housing cover and a housing base, between which the outer rotor and the inner rotor are arranged; and at least one compensation plate which is arranged in each case axially between the outer rotor and inner rotor and the housing cover or the housing base, wherein the at least one compensation plate in the idle state of the gerotor pump is axially spaced apart from the outer rotor and the inner rotor by pretensioning.

17 Claims, 3 Drawing Sheets

(58) Field of Classification Search
CPC ..... F04C 15/0042; F04C 15/06; F01C 1/103; F01C 1/104; F01C 21/108
See application file for complete search history.

(56) References Cited

U.S. PATENT DOCUMENTS

| | | | | | |
|---|---|---|---|---|---|
| 4,540,347 | A * | 9/1985 | Child | ..... | F01C 21/108 418/133 |
| 2002/0021978 | A1* | 2/2002 | Bodzak | ..... | F04C 15/0026 418/135 |
| 2017/0284391 | A1* | 10/2017 | Klippert | ..... | F04C 15/0026 |

FOREIGN PATENT DOCUMENTS

| | | | | | |
|---|---|---|---|---|---|
| DE | 112014003790 | B4 * | 2/2019 | ..... | B60K 17/28 |
| EP | 2235374 | B1 | 7/2011 | | |
| EP | 2538082 | A2 * | 12/2012 | ..... | F04C 14/265 |

OTHER PUBLICATIONS

EP-2538082-A2—Vogt et al.—Gear Pump With Variable Delivery Volume —Dec. 26, 2012—the English Machine Translation. (Year: 2012).*

Stryczek, Jaroslaw, Fundamentals of Designing Hydraulic Gear Machines, (ISBN: 978-83-01-21226-1), Polish Scientific Publishers PWN, 2020, 352 pages.

Bednarczyk, Slawomir, et al., Axial clearance compensation in the gerotor pump, The 20th International Conference on Hydraulics and Pneumatics, Prague, Sep. 29-Oct. 1, 2008, pp. 152-159.

German Office Action from the German Patent & Trademark Office for corresponding German Patent Application No. 102023122187.6 dated May 10, 2024, 7 pages.

European Office Action received by the European Patent Office for corresponding European Patent Application No. 24191735.0 dated Dec. 17, 2024, 9 pages.

* cited by examiner

GEROTOR PUMP AND MOTOR/PUMP UNIT

CROSS-REFERENCE TO RELATED APPLICATIONS

This application claims the benefit and priority of German Application No. DE 102023122187.6, filed Aug. 18, 2023. The entire disclosure of the above application is incorporated herein by reference.

FIELD

The invention relates to a gerotor pump for conveying a fluid and a motor/pump unit which has the gerotor pump.

BACKGROUND

This section provides background information related to the present disclosure which is not necessarily prior art.

Conventional gerotor pumps, also known as "toothed ring pumps" or "Eaton pumps", have a rotatable outer rotor and a rotatable inner rotor, wherein the inner rotor is arranged radially inside the outer rotor. Generally, the inner rotor is driven by a motor. In this instance, the inner rotor is in the form of a gear and the outer rotor is in the form of a toothed ring, wherein the inner rotor and the outer rotor have rotation axes which differ from each other. The outer rotor thereby runs eccentrically on an external tooth arrangement of the inner rotor. As a result of the changing volumes between the tooth gaps between the inner rotor and outer rotor, pressure regions are formed, also referred to as pump chambers, by means of which the fluid is conveyed.

"Fundamentals of Designing Hydraulic Gear Machines" by Jaroslaw Stryczek (ISBN: 978-83-01-21226-1) and "Axial clearance compensation in the gerotor pump" by Jaroslaw Stryczek and Slawomir Bednarczyk from "The 19th International Conference on Hydraulics and Pneumatics, Prague, September 29-Oct. 1, 2008" describe conventional axial compensation in gerotor pumps by means of compensation plates.

However, the conventionally known gerotor pumps have the disadvantage that production tolerances lead to a so-called axial gap between the inner rotor and outer rotor and the housing, in particular a housing cover or a housing base. Such an axial gap brings about an internal leakage of the fluid which is intended to be conveyed, whereby the degree of efficiency of the pump decreases. The conventional compensation plates mentioned above further have the disadvantage that the compensation plates in the idle state of the pump bear on active components, that is to say, on the inner rotor and outer rotor, with a degree of force, whereby the rotors are braked when the pump is started up. This is also referred to as "normally closed". The pump thereby requires an increased starting torque and consequently a higher power. Furthermore, the axial gap which is conventionally compensated for in particular at lower temperatures brings about a rapidly decreasing degree of efficiency of the pump since the fluid which is intended to be conveyed generally has a higher viscosity at lower temperatures. A wear of the pump, in particular as a result of friction between the rotors and the compensation plates, is also brought about in an unfavorable manner.

SUMMARY

This section provides a general summary of the disclosure, and is not a comprehensive disclosure of its full scope or all of its features.

An object is to provide a gerotor pump which can reduce an axial gap and which at the same time in a low pressure range has a high degree of efficiency and low wear.

The gerotor pump is configured and suitable for conveying a fluid from an inlet pump chamber which is connected to an inlet to an outlet pump chamber, which is connected to an outlet, of the gerotor pump. In this instance, the gerotor pump has a rotatable outer rotor and a rotatable inner rotor. The inner rotor is arranged radially inside the outer rotor. The gerotor pump further has a housing having a housing cover and a housing base. The outer rotor and the inner rotor are arranged between the housing cover and the housing base. Furthermore, the gerotor pump has at least one compensation plate which is arranged in each case axially between the outer rotor and inner rotor and the housing cover or the housing base. For example, the gerotor pump has at least one compensation plate which is arranged axially between the outer rotor and inner rotor and the housing cover, and/or at least one compensation plate which is arranged axially between the outer rotor and inner rotor and the housing base. In this instance, the at least one compensation plate in the idle state of the gerotor pump is axially spaced apart from the outer rotor and the inner rotor by pretensioning.

As a result of the fact that the at least one compensation plate by pretensioning in the idle state of the gerotor pump is spaced apart from the outer rotor and the inner rotor, a wear of the pump can be reduced and a degree of efficiency of the pump even in low pressure ranges can be improved. This is also referred to as "normally open".

In the following explanations, terms such as "the rotors" are intended to be understood to include the "inner rotor and outer rotor". Furthermore, above and below an element which is arranged, for example, "between the inner rotor and outer rotor and the housing (cover/base)" is intended to be understood to be an element which is arranged between the housing (cover/base) and the inner rotor and/or between the housing (cover/base) and the outer rotor, in particular with respect to the axial direction.

In an embodiment, the gerotor pump, as the at least one compensation plate, has an upper compensation plate and/or a lower compensation plate. In this instance, the upper compensation plate is arranged axially between the outer rotor and inner rotor and the housing cover. The lower compensation plate is in this instance arranged axially between the outer rotor and inner rotor and the housing base. The gerotor pump has only the upper compensation plate. Alternatively, the gerotor pump has only the lower compensation plate. In a further alternative manner, the gerotor pump has both the upper compensation plate and the lower compensation plate.

In an alternative embodiment, the gerotor pump has at least one resilient element which pretensions the upper compensation plate axially with respect to the housing cover and/or which pretensions the lower compensation plate axially with respect to the housing base. The at least one compensation plate is thereby pretensioned in such a manner that in the idle state of the gerotor pump it is axially spaced apart from the outer rotor and the inner rotor ("normally open").

The resilient element is a helical spring. The at least one compensation plate has at least one retention structure for the respective resilient element. For example, the at least one compensation plate has at least one recess ("resilient element recess"), for the at least one resilient element as a helical spring, in which an end of the helical spring is received. Alternatively or additionally, the compensation plate has as a retention structure a retention projection which in each case can receive an end of a leaf spring and retain it in a clamping manner. It is thereby possible for the at least one resilient element to be retained radially by the compensation plate.

In an embodiment in which the gerotor pump has the upper compensation plate and the lower compensation plate, the at least one resilient element is arranged axially between the upper and the lower compensation plate. In other words, the resilient element is axially clamped between the upper and lower compensation plate and pretensions it in an axial direction. The resilient element extends in this instance axially from the upper to the lower compensation plate and is preferably in direct contact with both.

The at least one compensation plate has at least one inlet through-hole which is connected in fluid terms to the inlet. Furthermore, the at least one compensation plate has at least one outlet through-hole which is connected in fluid terms to the outlet. A pressure compensation can thereby take place between a housing side and a rotor side of the compensation plate. Consequently, production tolerances of the gerotor pump can also expand, whereby the production is simplified.

In an embodiment, the at least one compensation plate has at least one first groove which extends on a housing-cover-side end face or on a housing-base-side end face of the compensation plate at least along a circumference of the compensation plate. This pretensioned groove promotes the pressure compensation between the housing side and the rotor side of the compensation plate. As a result of the above-mentioned pressure compensation, an axial pressure force which acts on the compensation plate is reduced or minimized.

The upper compensation plate has the first groove on the housing-cover-side end face. In a further manner, the lower compensation plate has the first groove on the housing-base-side end face. Alternatively or additionally, the lower compensation plate has a first groove on the housing-cover-side end face and/or the upper compensation plate has a first groove on the housing-base-side end face. In an exemplary case, in which at least one of the compensation plates has first grooves on both sides (on the housing base/housing cover) of the end faces thereof, they may be connected to each other in fluid terms by means of an axial groove.

The at least one groove is formed in at least one radial portion of the compensation plate(s) radially from the circumference to the radial center of the compensation plate. In other words, the groove extends from the circumference to the radial center of the compensation plate in at least one radial portion of the compensation plate. It is thereby possible for the fluid which reaches the above-mentioned groove of the compensation plate to reach a shaft and consequently to return to the inner rotor or the outer rotor. The respective groove(s) can also in each case extend in a plurality of radial portions of the corresponding compensation plate(s) to the radial center thereof, for example, at opposing radial portions with respect to the radial center.

In an embodiment of the gerotor pump, it has the upper compensation plate and the lower compensation plate, wherein the first groove of the upper compensation plate extends on the housing-cover-side end face and the first groove of the lower compensation plate extends on the housing-base-side end face. In other words, both the upper and the lower compensation plate have the first groove on the housing-side end faces thereof in contrast to the rotor-side end faces thereof.

The first groove has in particular the advantage that a gap between the compensation plate and the housing (housing base or housing cover) is reduced by the above-mentioned pressure compensation, even at high fluid pressures. Furthermore, a leakage of fluid can be guided back to the rotors.

The at least one compensation plate has at least one pump chamber groove. The respective pump chamber groove extends in this instance at a rotor-side end face of the respective compensation plate and defines together with intermediate spaces between the inner rotor and the outer rotor the inlet pump chamber or the outlet pump chamber. The respective compensation plate has a first pump chamber groove for the inlet pump chamber and a second pump chamber groove for the outlet pump chamber. Each of the compensation plates has the above-mentioned first and above-mentioned second pump chamber groove.

In a further manner, the gerotor pump has at least one compensation seal. The at least one compensation seal is arranged at a housing-cover-side or a housing-base-side end face of the at least one compensation plate. The respective compensation seal encloses a compensation face which is axially opposite the pump chamber groove. In this instance, a face enclosed by the pump chamber groove is smaller than the above-mentioned compensation face. As a result of the different (directly) opposing face sizes, which fluid reaches through the inlet/outlet through-holes at the same pressure, a directed force which counteracts the pretensioning and presses the compensation plate(s) to the rotor side is produced, whereby the axial gap during operation of the pump is reduced.

The pump chamber groove produces in particular a pressure face which during operation of the pump may be larger than the pump chamber groove. In such a case, the pressure face produced by the pump chamber groove is smaller than the above-mentioned compensation face. In other words, the above-mentioned compensation face is at least greater than the pump chamber groove, greater than the pressure face produced by the pump chamber groove.

The compensation seal surrounds in particular in each case the inlet through-hole(s) or the outlet through-holes(s).

In an example of the gerotor pump, the gerotor pump has four such compensation seals, that is to say, two on the upper compensation plate and two on the lower compensation plate. Each of these compensation seals is axially opposite a pump chamber groove of the respective compensation plate. As a result of the fact that the face enclosed by the pump chamber groove or its pressure face produced is smaller than the compensation face of the compensation seal, a directed force, which reduces the spacing between the at least one compensation plate and the outer rotor or the inner rotor is produced. As a result, the axial gap during operation of the pump, in particular at higher pressures, is reduced, whereby the degree of efficiency increases. When the pump is shut down into the idle state, the directed force becomes weaker so that the "normally open" state is produced again. In other words, the axial gap is decreased by hydraulic pressure.

The system further relates to a motor/pump unit. The motor/pump unit has a gerotor pump according to one of the above embodiments. Furthermore, the motor/pump unit has a motor which is connected to the inner rotor and which is configured to rotate the inner rotor in order to operate the gerotor pump. The motor is in particular mechanically connected to the inner rotor by a shaft. The motor/pump unit has an increased degree of efficiency and a low wear. Alternatively, the motor is connected to the outer rotor of the gerotor pump and operates it.

The gerotor pump and the motor/pump unit further have the following features. The (volumetric) degree of efficiency is increased, the wear is decreased, the starting torque is decreased, the operation of the pump is more efficient at low temperatures or higher viscosity of the fluid and the power requirement is reduced. Furthermore, the gerotor can be operated at higher pressures. An expansion of the production tolerances is further also possible.

Further areas of applicability will become apparent from the description provided herein. The description and specific examples in this summary are intended for purposes of illustration only and are not intended to limit the scope of the present disclosure.

BRIEF DESCRIPTION OF DRAWINGS

The drawings described herein are for illustrative purposes only of selected embodiments and not all possible implementations, and are not intended to limit the scope of the present disclosure.

Other details, advantages and features of the present invention will be appreciated from the following description of exemplary embodiments with reference to the drawings, in which.

Corresponding reference numerals indicate corresponding parts throughout the several views of the drawings.

DETAILED DESCRIPTION

Example embodiments will now be described more fully with reference to the accompanying drawings.

Figure 1:
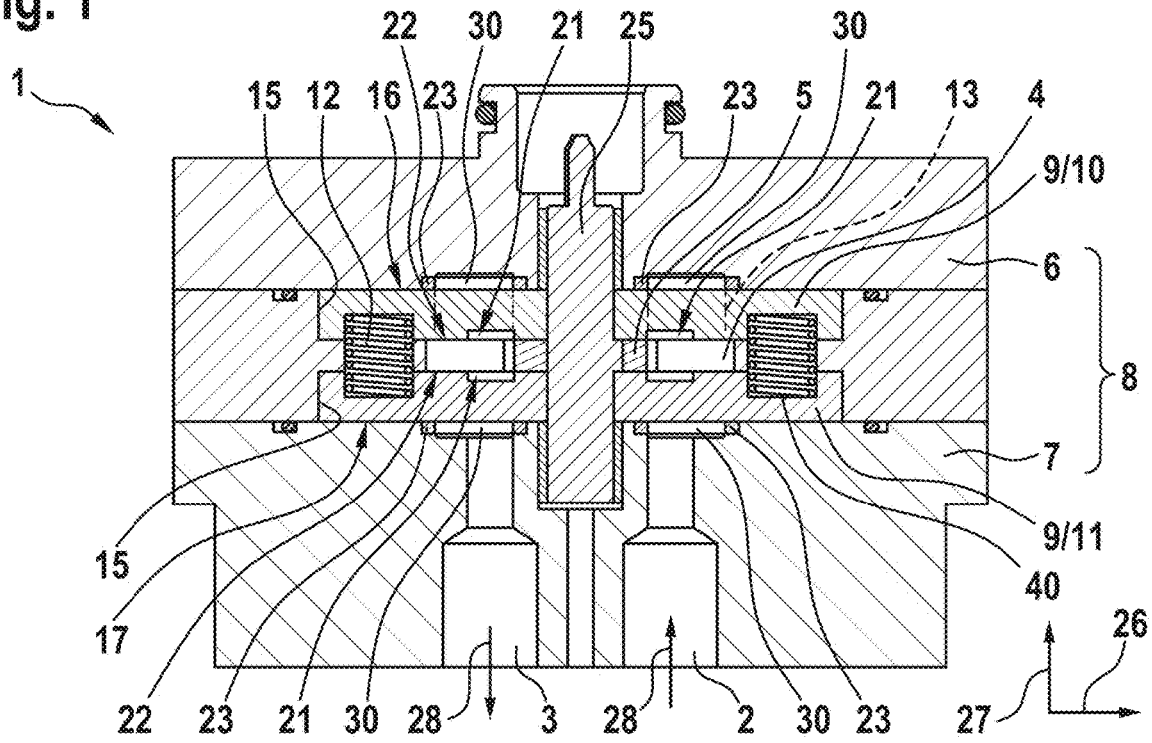
FIG. 1 shows a schematic cross sectional view of a gerotor pump according to an embodiment of the present invention.

FIG. 1 shows a schematic cross sectional view of a gerotor pump 1 according to a first embodiment of the present invention.

The gerotor pump 1 is configured and constructed to convey a fluid from an inlet pump chamber which is connected to an inlet 2 to an outlet pump chamber, which is connected to an outlet 3, of the gerotor pump 1.

In FIG. 1, arrows 28 indicate the exemplary fluid flow for explanation. The gerotor pump 1 has a rotatable outer rotor 4 and a rotatable inner rotor 5, wherein the inner rotor 5 is arranged radially inside the outer rotor 4. A radial direction 26 is illustrated in FIG. 1. The inner rotor 5 is connected to a shaft 25 which drives the inner rotor 5 during operation of the pump 1. An idle state is defined as no torque being applied by the shaft 25.

Furthermore, the gerotor pump 1 has a housing 8 having a housing cover 6 and a housing base 7, wherein the inner rotor 5 and the outer rotor 4 are arranged axially between the housing cover 7 and the housing base 7. An axial direction 27 is indicated in FIG. 1.

The gerotor pump 1 has in the present embodiment two compensation plates 9. In this instance, the gerotor pump 1 has an upper compensation plate 10 between the outer rotor 4 and inner rotor 5 and the housing cover 6 and a lower compensation plate 11 between the outer rotor 4 and inner rotor 5 and the housing base 7. The gerotor pump 1 of the present invention is, however, not limited thereto but instead may have only the upper compensation plate 10 or only the lower compensation plate 11.

The compensation plates 10, 11 are pretensioned by resilient elements 12, in this instance helical springs. In this instance, the upper compensation plate 10 is pretensioned in the direction toward the housing cover 6 and the lower compensation plate 10 is pretensioned in the direction toward the housing base 7. In an exemplary case, in which only one of the compensation plates 10, 11 is present, the resilient element 12 bears on the corresponding opposing housing cover 6 or housing base 7.

The resilient elements 12 result in the compensation plates 10, 11 in the idle state of the gerotor pump 1 being axially spaced apart from the outer rotor 4 and the inner rotor 5 by the pretensioning of the resilient elements 12. The friction between the compensation plates 10, 11 and the rotors 4, 5 is thereby reduced so that the gerotor pump 1 requires a small start-up torque.

The resilient elements 12 bring about the above-mentioned axial spacing between the compensation plates 10, 11 (or the respective compensation plate 10, 11 with respect to the opposing housing base 7 or housing cover 6), in particular in the idle state of the gerotor pump 1. During operation of the gerotor pump 1, in particular at higher pressures, the compensation plates 10, 11 are pressed toward each other by the pressurized fluid. In other words, during operation of the gerotor pump 1, the upper compensation plate 10 is pressed in the direction toward the housing base 7 and/or the lower compensation plate 11 is pressed in the direction toward the housing cover 6. This is explained below.

Figure 2:
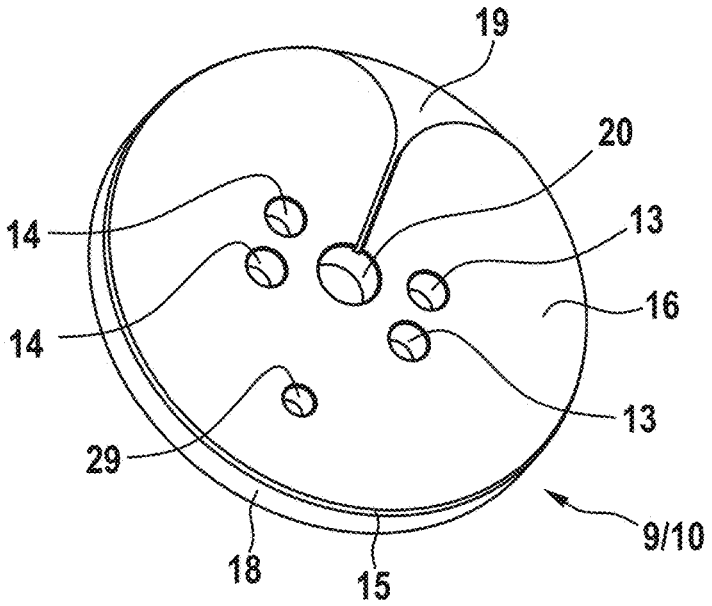
FIG. 2 shows a perspective view of a compensation plate of the gerotor pump according to the embodiment of the present invention.

FIG. 2 shows a perspective view of a compensation plate 9 of the gerotor pump 1 according to the present embodiment. FIG. 2 shows in particular the upper compensation plate 10, wherein the explanations below can alternatively or additionally describe the lower compensation plate 11 (in particular transposed with reference to the axial direction 27). Furthermore, the explanations above and below relate to a recovery gerotor pump which can be operated in a bidirectional manner. However, the invention may also be used for a unidirectional gerotor pump. In this instance, the axial compensation is preferably carried out only at one side from the high-pressure side or low-pressure side, in particular only at the high-pressure side. In other words, only the left half of the gerotor pump 1 illustrated in FIG. 1 may have the structures described, whilst the right half (low-pressure side or tank pressure side) may be configured in accordance with a conventional gerotor pump. In this instance, the compensation plate 10 illustrated in FIG. 2 may also be substantially halved with respect to its circumference. In other words, in place of a 360° configuration illustrated (circular), the compensation plate 10 may comprise approximately 160° or more, preferably approximately 180° or more, more preferably 190° or more, preferably no more than 270° (part-circular). Naturally, a geometric form other than circular may also be selected, depending on the provisions.

As can be seen in FIG. 2, the compensation plate 10 has an end face 16. With respect to the upper compensation plate 10, the end face 16 is a housing-cover-side end face 16 (cf. FIG. 1). The compensation plate 10 has a groove 15 which extends at the housing-cover-side end face 16 along a circumference 18 of the compensation plate 10. As a comparison of FIG. 2 with FIG. 1 shows, the lower compensation plate 11 has the first groove 15 at a housing-base-side end face 17. As can further be seen in FIG. 2, the groove 15 extends in a radial portion 19 of the compensation plate 10 radially from the circumference 18 to the radial center 20 of the compensation plate 10. The shaft 25 illustrated in FIG. 1 extends through the radial center 20 of the compensation plate 10.

It is thereby possible for pressurized fluid which reaches a region between the upper compensation plate 10 and the housing cover 6 or between the lower compensation plate 11 and the housing base 7, to be able to return back to the shaft 25 and consequently back to the inner rotor 5 or outer rotor 4. In this instance, the radial center 20 of the compensation plate 10 can receive the shaft 25 with a clearance fit so that fluid can flow through the radial center 20 (radially) between the shaft 25 and compensation plate 10 in an axial direction 27.

Furthermore, the compensation plate 10 has in the present embodiment two inlet through-holes 13 which are connected in fluid terms to the inlet 2. Furthermore, the compensation plate 10 has in this instance two outlet through-holes 14 which are connected in fluid terms to the outlet 3.

A recess 29 of the compensation plate 10 as illustrated in FIG. 2 is configured to receive a locking pin (not illustrated) which prevents the compensation plate 10 from being rotated during operation of the pump 1.

FIG. 2 further illustrates resilient element recesses 40 which in each case receive a resilient element 12.

The compensation plate(s) 10 (upper and/or lower) may further have a plurality of the grooves 15 described above, for example, one on each of the end faces 16, 17 of the compensation plate(s) 10. In such an exemplary case, the two grooves 15 may be connected in fluid terms by at least one axially extending groove of the compensation plate(s) 10. A pressure compensation between both sides of the compensation plate(s) 10 can thereby be achieved so that axial pressure forces on them can be reduced or minimized.

In FIG. 1, the inlet through-holes 13 and the outlet through-holes 14 are illustrated with broken lines for the upper compensation plate 10.

Figure 3:
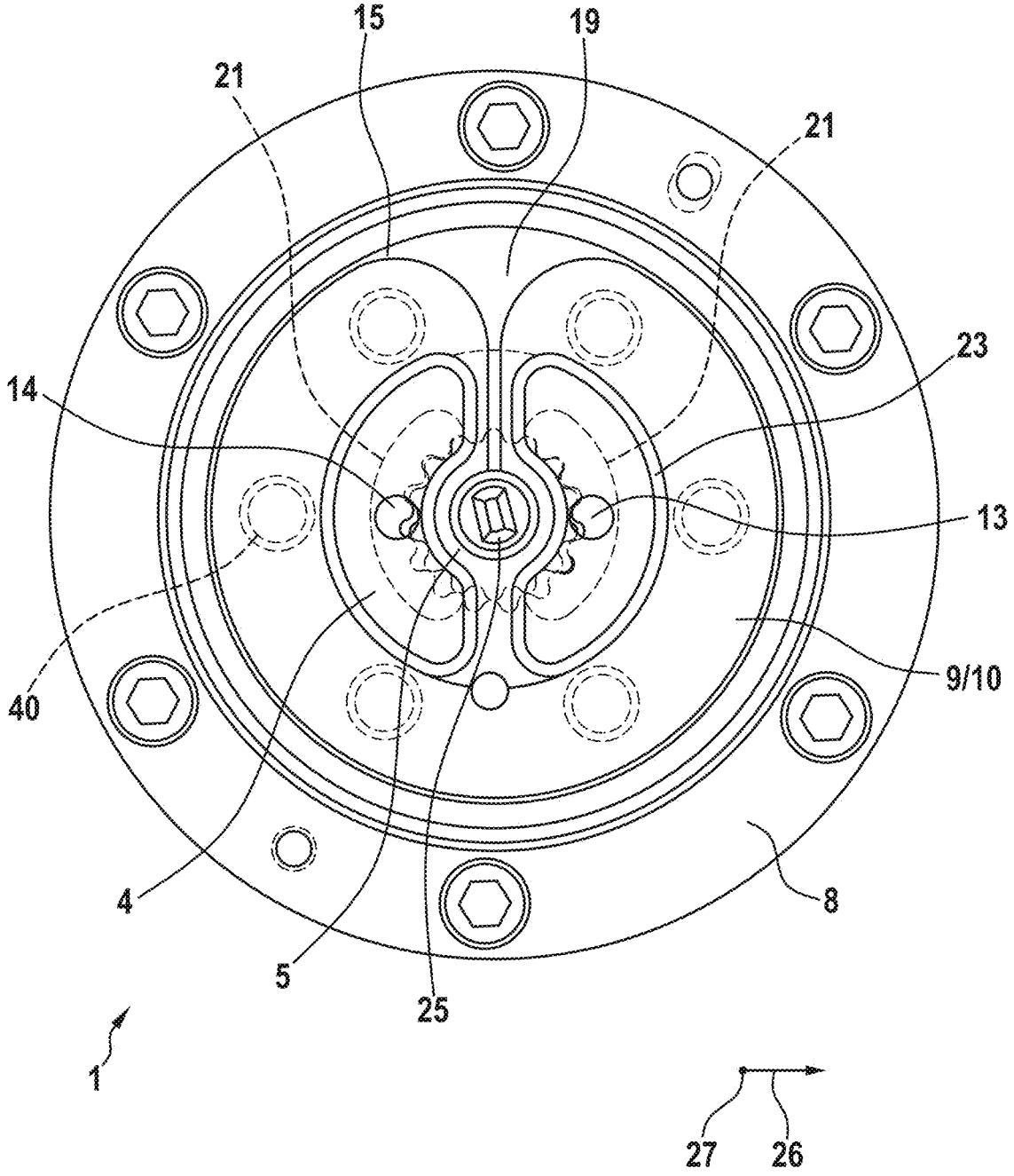
FIG. 3 shows a schematic sectioned view of the gerotor pump according to the embodiment of the present invention.

FIG. 3 is a schematic sectioned view of the gerotor pump 1 according to the present embodiment. The sectioned view of FIG. 3 shows in particular a plan view in the axial direction 27 with a transparent housing cover 6.

As can be seen in FIG. 3, the gerotor pump 1 has according to the present embodiment a pump chamber groove 21 for the inlet pump chamber and a pump chamber groove 21 for the outlet pump chamber. These pump chamber grooves 21 are formed in the rotor-side end face 22 of the compensation plate 10 (illustrated with broken lines). The lower compensation plate 11 may also have these pump chamber grooves 21. The pump chamber grooves 21 define together with intermediate spaces between the inner rotor 5 and outer rotor 4 the inlet pump chamber and the outlet pump chamber (in each case).

As the sectioned illustration of FIG. 1 shows, these pump chamber grooves 21 are arranged axially opposite, in particular axially directly opposite, compensation seals 23 (or the enclosed faces thereof. The compensation seals 23, which are illustrated in FIG. 3, enclose compensation faces which are axially opposite the corresponding pump chamber grooves 21. The compensation face which is enclosed by the compensation seal 23 and the pump chamber groove 21 are connected in fluid terms by the corresponding inlet through-holes 13 or outlet through-holes 14.

The pressurized fluid flows from the inlet pump chamber (from the corresponding pump chamber grove 21) through the inlet through-hole 13 into a compensation space 30 enclosed by the compensation seal 23 in the housing cover 6 or in the housing base 7. This is illustrated in FIG. 1.

As shown in particular by a comparison of FIG. 1 with FIG. 3, the compensation face which is enclosed by the compensation seal 23 is greater than a face enclosed by the pump chamber groove 21. Since the fluid in the pump chamber groove 21 has the same pressure as the fluid in the compensation space 30, and the compensation face is greater than the face enclosed by the pump chamber groove 21, the pressurized fluid applies a greater force to the compensation face than to the pump chamber groove 21 ($P=F/A$; $F=P*A$). Consequently, an overall force which counteracts the pretensioning by means of the resilient elements 12 is produced.

In other words, the compensation plates 10, 11 during operation of the pump 1 are pressed axially toward the inner rotor 5 and the outer rotor 4, whereby the axial gap is reduced at higher pressures. The degree of efficiency of the gerotor pump 1 thereby increases for higher pressures. At lower pressures, as a result of the pretensioning of the compensation plates 10, 11, the viscous friction is reduced and consequently a start-up torque of the gerotor pump 1 is also reduced. These are in particular achieved by suitable adaptation of the compensation face.

Figure 4:
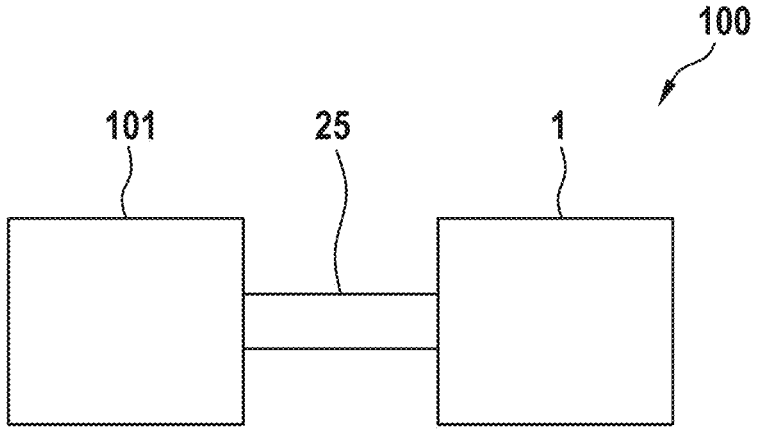
FIG. 4 shows a schematic block diagram of a motor/pump unit according to another embodiment of the present invention.

FIG. 4 shows a schematic block diagram of a motor/pump unit 100 according to an embodiment of the present invention.

The motor/pump unit 100 has a motor 101 and a gerotor pump 1 according to the present invention. The motor 101 is configured to rotate the inner rotor 5 in order to operate the gerotor pump 1. In this instance, the motor 101 is mechanically connected to the inner rotor 5 by the shaft 25 (see further FIG. 1). The motor/pump unit 100 has a degree of efficiency and a particularly long service-life.

In addition to the above written description of the invention, for additional disclosure reference may explicitly hereby be made to the illustrated drawings of the invention in the Figures.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

List of reference numerals

| | |
|---|---|
| 1 | Gerotor pump |
| 2 | Inlet |
| 3 | Outlet |
| 4 | Outer rotor |
| 5 | Inner rotor |

-continued

| List of reference numerals | |
|---|---|
| 6 | Housing cover |
| 7 | Housing base |
| 8 | Housing |
| 9 | Compensation plate |
| 10 | Upper compensation plate |
| 11 | Lower compensation plate |
| 12 | Resilient element |
| 13 | Inlet through-hole |
| 14 | Outlet through-hole |
| 15 | Groove |
| 17 | End face |
| 18 | Circumference |
| 19 | Radial portion |
| 20 | Radial center |
| 21 | Pump chamber groove |
| 22 | Rotor-side end face |
| 23 | Compensation seal |
| 25 | Shaft |
| 26 | Radial direction |
| 27 | Axial direction |
| 28 | Fluid flow |
| 29 | Recess |
| 30 | Compensation space |
| 40 | Resilient element recess |

What is claimed is:

1. A gerotor pump for conveying a fluid from an inlet pump chamber which is connected to an inlet to an outlet pump chamber, which is connected to an outlet, of the gerotor pump having:

a rotatable outer rotor;

a rotatable inner rotor which is arranged radially inside the outer rotor;

a housing having a housing cover and a housing base, between which the outer rotor and the inner rotor are arranged; and at least one compensation plate which is arranged in each case axially between the outer rotor and inner rotor and the housing cover or the housing base, wherein the at least one compensation plate in the idle state of the gerotor pump is axially spaced apart from the outer rotor and the inner rotor by pretensioning;

wherein the at least one compensation plate has at least one first groove which extends on a housing-cover-side end face or on a housing-base-side end face at least along a circumference of the compensation plate and extends in at least one radial portion of the compensation plate radially from the circumference to a radial center of the compensation plate.

2. The gerotor pump as claimed in claim 1, having, as the at least one compensation plate, at least one of an upper compensation plate which is arranged axially between the outer rotor and inner rotor and the housing cover and a lower compensation plate which is arranged axially between the outer rotor and inner rotor and the housing base.

3. The gerotor pump as claimed in claim 2, having at least one resilient element which pretensions the at least one of the upper compensation plate axially with respect to the housing cover and the lower compensation plate axially with respect to the housing base.

4. The gerotor pump as claimed in claim 1, wherein the at least one compensation plate has at least one inlet through-hole which is connected in fluid terms to the inlet and at least one outlet through-hole which is connected in fluid terms to the outlet.

5. The gerotor pump as claimed in claim 1, wherein the at least one compensation plate has at least one pump chamber groove which extends at a rotor-side end face and which together with intermediate spaces between the inner rotor and the outer rotor defines the inlet pump chamber or the outlet pump chamber.

6. The gerotor pump as claimed in claim 5, having at least one compensation seal which is arranged at a housing-cover-side or a housing-base-side end face of the at least one compensation plate and which encloses a compensation face which is axially opposite the pump chamber groove, wherein a face enclosed by the pump chamber groove is smaller than the compensation face.

7. A motor/pump unit having:

a gerotor pump as claimed in claim 1; and a motor which is connected to the inner rotor and which is configured to rotate the inner rotor in order to operate the gerotor pump.

8. A gerotor pump for conveying a fluid from an inlet pump chamber which is connected to an inlet to an outlet pump chamber, which is connected to an outlet, of the gerotor pump having:

a rotatable outer rotor;

a rotatable inner rotor which is arranged radially inside the outer rotor;

a housing having a housing cover and a housing base, between which the outer rotor and the inner rotor are arranged; and an upper compensation plate and a lower compensation plate, the upper compensation plate is arranged axially between the outer rotor and inner rotor and the housing cover and the lower compensation plate is arranged axially between the outer rotor and inner rotor and the housing base;

wherein at least one resilient element is arranged axially between the upper and the lower compensation plate;

wherein the upper and lower compensation plate in the idle state of the gerotor pump are axially spaced apart from the outer rotor and the inner rotor by pretensioning.

9. The gerotor pump as claimed in claim 8, wherein at least one of the upper and lower compensation plate has at least one first groove which extends on a housing-cover-side end face or on a housing-base-side end face at least along a circumference of the at least one upper and lower compensation plate.

10. The gerotor pump as claimed in claim 9, wherein the at least one first groove extends in at least one radial portion of the at least one of the upper and lower compensation plate radially from the circumference to the radial center of the at least one of the upper and lower compensation plate.

11. A motor/pump unit having:

a gerotor pump as claimed in claim 8; and a motor which is connected to the inner rotor and which is configured to rotate the inner rotor in order to operate the gerotor pump.

12. The gerotor pump as claimed in claim 8, wherein at least one of the upper and lower compensation plate has at least one pump chamber groove which extends at a rotor-side end face and which together with intermediate spaces between the inner rotor and the outer rotor defines the inlet pump chamber or the outlet pump chamber.

13. The gerotor pump as claimed in claim 12, having at least one compensation seal which is arranged at a housing-cover-side or a housing-base-side end face of the at least one upper and lower compensation plate and which encloses a compensation face which is axially opposite the pump chamber groove, wherein a face enclosed by the pump chamber groove is smaller than the compensation face.

14. A gerotor pump for conveying a fluid from an inlet pump chamber which is connected to an inlet to an outlet pump chamber, which is connected to an outlet, of the gerotor pump having:

a rotatable outer rotor;

a rotatable inner rotor which is arranged radially inside the outer rotor;

a housing having a housing cover and a housing base, between which the outer rotor and the inner rotor are arranged; and at least one compensation plate which is arranged in each case axially between the outer rotor and inner rotor and the housing cover or the housing base, wherein the at least one compensation plate in the idle state of the gerotor pump is axially spaced apart from the outer rotor and the inner rotor by pretensioning;

wherein the at least one compensation plate has at least one pump chamber groove which extends at a rotor-side end face and which together with intermediate spaces between the inner rotor and the outer rotor defines the inlet pump chamber or the outlet pump chamber;

having at least one compensation seal which is arranged at a housing-cover-side or a housing-base-side end face of the at least one compensation plate and which encloses a compensation face which is axially opposite the pump chamber groove, wherein a face enclosed by the pump chamber groove is smaller than the compensation face and the face is axially positioned within the compensation face.

15. The gerotor pump as claimed in claim 14, wherein the at least one compensation plate has at least one first groove which extends on a housing-cover-side end face or on a housing-base-side end face at least along a circumference of the compensation plate.

16. The gerotor pump as claimed in claim 15, wherein the at least one first groove extends in at least one radial portion of the compensation plate radially from the circumference to the radial center of the compensation plate.

17. A motor/pump unit having:

a gerotor pump as claimed in claim 14; and a motor which is connected to the inner rotor and which is configured to rotate the inner rotor in order to operate the gerotor pump.

* * * * *